US005417160A

United States Patent [19]

Mei et al.

[11] Patent Number: 5,417,160

[45] Date of Patent: May 23, 1995

[54] LEAD-FREE PRIMING MIXTURE FOR PERCUSSION PRIMER

[75] Inventors: George C. Mei, St. Louis, Mo.; James W. Pickett, Gillespie, Ill.

[73] Assignee: Olin Corporation, East Alton, Ill.

[21] Appl. No.: 159,609

[22] Filed: Dec. 1, 1993

[51] Int. Cl.[6] ..... C06B 45/00; C06C 5/06

[52] U.S. Cl. ..... 102/289; 102/290; 102/275.11; 149/68

[58] Field of Search ..... 102/289, 290, 275.11; 149/68

[56] References Cited

U.S. PATENT DOCUMENTS

| | | | |
|---|---|---|---|
| 2,104,513 | 1/1938 | Fisher et al. | 52/4 |
| 2,190,777 | 2/1940 | Etchells | 52/4 |
| 4,363,679 | 12/1982 | Hagel et al. | 149/37 |
| 4,522,665 | 6/1985 | Yates, Jr. et al. | 149/21 |
| 4,532,866 | 8/1985 | Lagofun | 102/204 |
| 4,566,921 | 1/1986 | Duguet | 149/22 |
| 4,576,059 | 6/1987 | Mei | 149/43 |
| 4,608,102 | 8/1986 | Krampen et al. | 149/92 |
| 4,674,409 | 6/1987 | Lopata et al. | 102/471 |
| 4,689,185 | 8/1987 | Lopata et al. | 264/34 |
| 4,963,201 | 10/1990 | Bjerke et al. | 149/2 |
| 5,035,757 | 7/1991 | Poole | 149/46 |
| 5,167,736 | 12/1992 | Mei et al. | 149/22 |
| 5,216,199 | 6/1993 | Bjerke et al. | 102/471 |
| 5,353,707 | 10/1994 | Duguet | 149/92 |

*Primary Examiner*—Peter A. Nelson
*Attorney, Agent, or Firm*—Gregory S. Rosenblatt

[57] ABSTRACT

There is provided a lead-free primer mix having high sensitivity. The primer mix contains an initiating explosive, a sensitizer, a propellant, calcium silicide and an oxidizer. The ignition exhaust products are essentially free of toxic oxides such as lead oxide, barium oxide and antimony oxide.

21 Claims, 1 Drawing Sheet

LEAD-FREE PRIMING MIXTURE FOR PERCUSSION PRIMER

BACKGROUND OF THE INVENTION

This invention relates to a primer mix for a percussion primer. More particularly, the substantially lead free primer mix contains calcium silicide and dinol. The primer mix has sufficient sensitivity for use in both Boxer and Berdan primer systems.

For approximately the last fifty years, the primary explosive used in small arms primer compositions has been lead styphnate. The lead styphnate is combined with oxidizing and reducing agents, sensitizers and other fuels. Typical additions to lead styphnate include tetracene, aluminum, antimony sulfide, calcium silicate, lead peroxide, boron, pyrophoric metals and barium nitrate. Variations in the ingredients and their relative amounts result in chemical systems which possess sensitivity and propellant ignition properties tailored to specific requirements. These priming compositions are, and for the most part, still in current use in small arms primers.

However, concerns over environmental hazards and the potential effects on individual health, primarily in indoor shooting ranges, has lead to concerns with the primer exhaust. The lead styphnate based primers exhaust toxic oxides of lead, and typically also barium and antimony oxides. Extensive research has been done to find a replacement primer which (1) does not produce toxic exhaust products; (2) has a consistent ignition pressure and velocity; (3) and has sufficient sensitivity for use in both Boxer and Berdan priming systems.

Non,toxic primer compositions are disclosed in U.S. Pat. Nos. 4,963,201 to Bjerke et al and in 5,167,736 to Mei and Pickett, both of which are incorporated by reference in their entireties herein.

The Bjerke et al patent discloses a non-toxic primer mix containing dinol, tetracene, a nitrate ester fuel and strontium nitrate. The exhaust product from ignition of this mix does not contain lead, barium or antimony oxides. The exhaust product does contain strontium oxide slag. The sensitivity is less than that of a lead styphnate based primer. While suitable for use in Berdan primers, the sensitivity is marginal for Boxer primers.

The Boxer primers have a self contained anvil which allows the primer to be sold as a component and the pistol user can reload shells. The capability to reuse shells makes priming mixes having sufficient sensitivity for use in Boxer primers desirable in both military and commercial applications.

The Mei and Pickett patent discloses a non-toxic primer mix for use in both Boxer and Berdan percussion primers. The mix contains dinol and boron. Calcium silicide is disclosed as useful as an abrasive sensitizer and as a reducing agent.

While these non-toxic priming mixes are suitable, there exists a need for other non-toxic priming mixes which have sufficient sensitivity for Boxer primer systems.

SUMMARY OF THE INVENTION

Accordingly, it is an object of the invention to provide a priming mixture which does not generate toxic oxides upon ignition and has sufficient sensitivity for use in both Berdan and Boxer primers. It is a feature of the invention that this priming mix contains dinol and calcium silicide. In preferred embodiments, specified amounts of tetracene, a propellant and potassium nitrate are also present. Yet another feature of the invention is that the priming mix sensitivity, in both 9 millimeter shells and 38 special shells, was well within the SAAMI specifications. SAAMI refers to the Sporting Arms and Ammunition Manufacturers Institute.

It is an advantage of the invention that ignition of the non-toxic priming mix does not generate toxic oxides. Additionally, the priming mix has sufficient sensitivity for use in both Boxer and Berdan type primers.

In accordance with the invention, there is provided a primer mix which consists essentially of an explosive powder mixed with a pyrotechnic powder. The pyrotechnic powder comprises calcium silicide and an oxidizer.

A preferred primer mix of the invention consists essentially of from about 20% to about 50% by weight dinol, from about 2% to about 10% by weight tetracene, from about 5% to about 30% by weight of a propellant, from about 2% to about 20% by weight calcium silicide and from about 20% to about 50% by weight potassium nitrate.

The above stated objects, features and advantages will become more apparent from the specification and drawings which follow.

IN THE DRAWINGS

DETAILED DESCRIPTION

Figure 1:
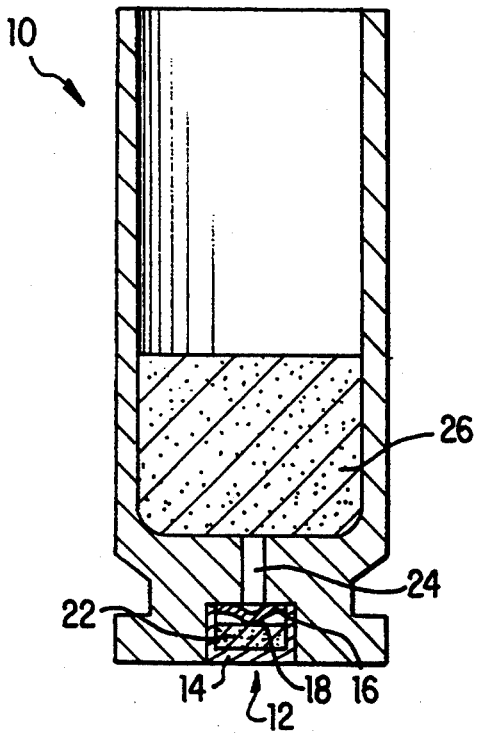
FIG. 1 shows in cross-sectional representation a small arms cartridge utilizing a Boxer primer.

Applicants' primer mix contains a pyrotechnic mix combined with an explosive mix. The pyrotechnic mix contains calcium silicide as a fuel and an oxidizer. The preferred oxidizers are one or more alkaline and alkaline earth nitrate compounds. Potassium nitrate is a preferred oxidizer.

Any suitable explosive mix may be used. Typical explosive mixes include a mixture of an initiating explosive, a sensitizer and a propellant. Among the suitable initiating explosives are nitrotetrazoles such as dinitrobenzotriazole, dinitrotolutriazole and diazodinitrophenol (dinol) as well as mixtures thereof.

One effective sensitizer is tetracene. The propellant is any suitable nitrated ester such as pentaerythritoltetranitrate (PETN), nitroglycerin, and nitrocellulose. Mixed propellant fines such as 60% nitrocellulose and 40% nitroglycerin, as well as other ratios, are satisfactory. These commercially available propellants are available in small particle size (such as from about 0.010 to about 0.020 inch in diameter).

Other suitable propellants include dinitrotoluene, picric acid and nitroquanidine. The propellant may also be a mixture of specified propellants.

One preferred propellant comprises propellant flakes and is offered by Hercules Incorporated (Camden, N.J.) as the 1500 Series propellant. The propellant consists of flakes of a size which will pass through a 30 mesh screen and have the composition 30% nitroglycerin and 70% nitrocellulose. The flakes may be coated with graphite to improve flow during primer mixing and loading.

Applicants' preferred primer mix consists essentially of:

from about 10% to about 50% by weight of an initiating explosive;

from about 2% to about 10% by weight of a sensitizer;

from about 3% to about 30% by weight of a propellant;

from about 2% to about 20% calcium silicide; and from about 20% to about 50% by weight of an oxidizer.

Utilizing the preferred primer constituents, the primer mix consists essentially of:

from about 10% to about 50% by weight dinol;

from about 2% to about 10% by .weight tetracene;

from about 3% to about 30% by weight of a propellant;

from about 2% to about 20% calcium silicide; and from about 20% to about 50% by weight potassium nitrate.

When the amount of initiating explosive is less than 10%, the primer mix has too low a brisance. Ignition of the primer is as a puff rather than an energetic explosion. If the content is above 50%, the brisance is too high and the initiating explosion too violent.

The content of the sensitizer is from 2% to about 10% by weight. Below 2%, the sensitivity is low and the frequency of primer "no-fire" failures increases. Increasing the amount of sensitizer above 10% does not contribute to any additional increase in sensitivity.

The amount of propellant is from 3% to 30%. A propellant content of less than about 3% lacks sufficient brisance to ignite the main charge. Above 30%, the brisance is too high and the primer too energetic.

The pyrotechnic component of the primer mix is calcium silicide and an oxidizer. The calcium silicide provides the heat to ignite the explosive mix. When the calcium silicide content is less than about 2% by weight, insufficient heat is generated to ensure ignition of the explosive mix. When the calcium silicide content is above about 20%, the fuel energy is primarily discharged as a flash rather than as heat resulting in poor combustion and a high particulate content in the ignition product.

A sufficient amount of oxidizer is present to provide for a high temperature, consistent burn of the calcium silicide. This content is preferably from about 20% to about 50%.

In preferred embodiments of the invention, the dinol content is from about 20% to about 45% by weight and more preferably from about 25% to about 40% by weight. The tetracene content is preferably from about 3% to about 8% by weight and the propellant content preferably from about 5% to about 25% by weight. The calcium silicide is preferably present in an amount from about 5% to about 15% and most preferably, in an amount of about 8% to about 12%. The oxidizer is preferably present in an amount of from about 25% to about 40%.

A preferred primer mix consists essentially of:

from about 20% to about 45% by weight dinol;

from about 3% to about 8% by weight tetracene;

from about 5% to about 25% by weight of a propellant;

from about 5% to about 15% by weight calcium silicide and from about 25% to about 40% by weight nitrate.

Figure 2:
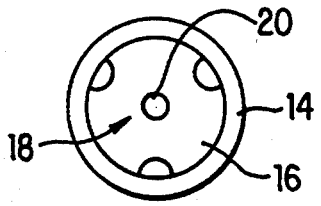
FIG. 2 shows in top planar view the Boxer primer of FIG. 1.

The primer mix is placed in a primer cup utilizing either the Boxer or the Berdan system. FIG. 1 shows in cross-sectional representation a small arms cartridge 10 having a Boxer percussion primer 12. The primer mix 22 is ignited when a firing pin strikes the primer holder 14. The primer holder 14 is of generally cup-shaped configuration having a closed end and an open end. A metallic anvil 16 extends across the open end of the primer holder 14. The metallic anvil has a centrally depressed region 18 and at least one aperture. FIG. 2 illustrates in top planar view the positioning of the metallic anvil 16 and the aperture 20 located within the centrally depressed region 18.

Referring back to FIG. 1, the primer mix 22 is contained with the primer holder 14. The primer mix 22 contacts both the closed end of the primer holder 14 and the centrally depressed region 18 of the metallic anvil 16.

When the closed end of the primer holder 14 is struck by a firing pin, the centrally depressed region 18 is energetically driven into the primer mix 22, generating a shock wave which ignites the primer mix 22. The heat and flame generated by ignition travels through the central bore igniting the primary explosive 26 which fires a bullet or other projectile (not shown).

Figure 3:
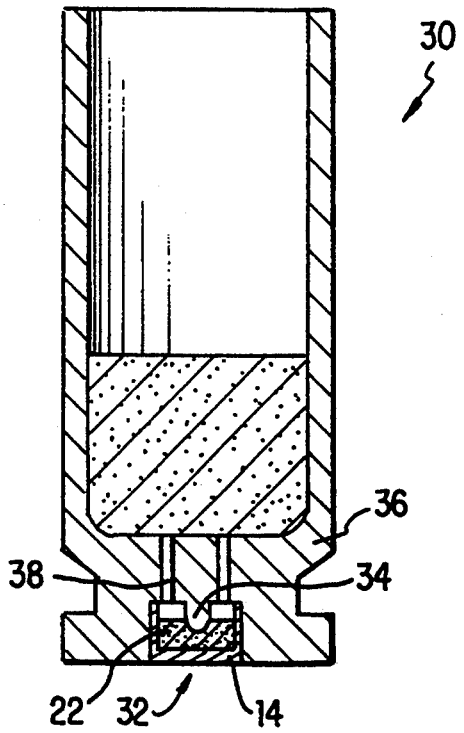
FIG. 3 shows in cross-sectional representation a small arms cartridge utilizing a Berdan primer.

FIG. 3 shows in cross-sectional representation a small arms cartridge 30 having a Berdan primer 32. The primer holder 14 is of substantially the same configuration as the primer holder of FIG. 1 having a generally cup-shaped configuration with a closed end and an open end. The primer mix 22 is contained within the primer holder 14 and contacts both the closed end of the primer holder and a protrusion 34 extending from the base of the cartridge jacket 36.

The primer mix 22 contacts both the closed end of the primer holder 14 and the protrusion 34. When the closed end of the primer holder 14 is struck by a firing pin, the protrusion 34 is driven into the primer mix 22, generating a shock wave which ignites the primer mix 22. Ignition of the primer mix 22 generates a flame which travels through twin bores 38 to ignite the primary explosive 26, firing the bullet or other projectile (not shown).

The following examples, which are intended to be exemplary and not limiting, demonstrate the benefits of the inventive primer mix.

EXAMPLES

A primer mix having the following composition was utilized for all Examples:

40% by weight dinol;

6% by weight tetracene;

8% by weight propellant fines (30% nitroglycerin, 70% nitrocellulose);

10% calcium silicide; and

36% potassium nitrate.

The primer mix was charged into a standard Boxer small pistol primer cup and assembled. The primer was then tested according to the SAAMI specification for small pistol primer sensitivity. The requirements are no samples fire when a 1.94 ounce test weight is dropped from a height of 1 inch into the primer mix. All samples must fire when the weight is dropped from a height of 11 inches. When the primer mix was tested in a 38 Special shell, the results of Table 1 were obtained.

TABLE 1

| HEIGHT | Number of NO FIRES (50 tested) |
|---|---|
| 2 inches | 50 |
| 3 inches | 38 |
| 4 inches | 22 |
| 5 inches | 2 |
| 6 inches | 0 |

The Table 1 results provide an H-bar (the height at which 50% of the test primers fire) of 3.94 inches and an H-bar plus 4 Sigma (predicted all fire height) of 6.49 inches.

Table 2 indicates the results when tested in a 9 millimeter shell case.

TABLE 2

| HEIGHT | Number of NO FIRES (out of 50 tested) |
|---|---|
| 3 inches | 50 |
| 4 inches | 39 |
| 5 inches | 16 |
| 6 inches | 1 |
| 7 inches | 0 |

The Table 2 results provide an H-bar was 4.62 inches and the H-bar plus 4 sigma was 7.68 inches.

As illustrated in Table 3, for both 9 millimeter and 38 Special cartridges, the velocity and pressure of the primer mix of the invention is about equal to or better than that of a conventional lead based mix. The performance of the primer mix is uniform over a wide range of temperatures. In each case, the equilibrium time is 4 hours. The number of samples tested is 10 at 70° F. and 140 ° F. 25 samples were tested at −40°F.

The relatively low standard deviations of the primer mixes of the invention indicate that consistent results could be expected from shell to shell.

TABLE 3

| Sample* | Storage Temp. °F. | Ignition Pressure psi/100 | Standard Deviation | Velocity ft/sec. | Standard Deviation |
|---|---|---|---|---|---|
| 9mm-I | 70° | 1193 | 7.5 | 333 | 8.5 |
| 9mm-C | 70° | 1212 | 6.5 | 353 | 6.5 |
| 9mm-I | 140° | 1202.5 | 8.5 | 343 | 9.5 |
| 9mm-C | 140° | 1192.5 | 9.5 | 332.5 | 10 |
| 9mm-I | −40° | 1200 | 10.5 | 349.5 | 11.5 |
| 9mm-C | −40° | 1208 | 19.5 | 354 | 18.5 |
| 38S-I | 70° | 1014 | 25.5 | 125.5 | 11 |
| 38S-C | 70° | 1009.5 | 21 | 120 | 8 |
| 38S-I | 140° | 1062.5 | 34 | 129 | 8.5 |
| 38S-C | 140° | 1059.5 | 36 | 129.5 | 6 |
| 38S-I | −40° | 935 | 37 | 121 | 10 |
| 38S-C | −40° | 930 | 44 | 121.5 | 12 |

*9mm (9 millimeter Luger) and 38S (38 Special) refer to cartridge type, I (inventive) and C (conventional lead styphnate based) refer to the primer type.

The ignition products of the primer mix should be non-toxic and predominantly gaseous. The ignition product (at the chamber) of the primer mix used for the Examples has the theoretically calculated composition illustrated in Table 4. Further oxidation of the ignition products would take place at the muzzle.

TABLE 4

| COMPONENT | WEIGHT PERCENT |
|---|---|
| CO | 34.04 |
| $CO_2$ | 6.75 |
| K | 3.88 |
| $N_2$ | 21.19 |
| KOH* | 8.46 |
| $H_2O$ | 0.86 |

TABLE 4-continued

| COMPONENT | WEIGHT PERCENT |
|---|---|
| $H_2$ | 0.50 |
| CaO* | 5.82 |
| $SiO_2$* | 12.47 |
| KOH | 5.74 |

*These components are solid ignition products, the remainder are gaseous. The weight percent of solids is about 26.75%. The remaining 0.3% is made up of various gaseous ignition products present in an amount of less than 0.2% by weight.

It is apparent that there has been provided in accordance with the present invention a non-toxic primer mix which fully satisfies the objects, means and advantages set forth hereinabove. While the invention has been described in combination with the embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A substantially lead-free primer mix consisting essentially of:

an explosive powder which includes dinol mixed with a pyrotechnic powder wherein said pyrotechnic powder comprises calcium silicide and an oxidizer.

2. A primer mix consisting essentially of:

from about 10% to about 50% by weight of an initiating explosive;

from about 2% to about 10% by weight of a sensitizer;

from about 3% to about 30% by weight of a propellant;

from about 2% to about 20% by weight calcium silicide;

from about 20% to about 50% by weight of an oxidizer.

3. The primer mix of claim 2 wherein said initiating explosive is selected from the group consisting of nitrobenzotriazole, nitrotolutriazole and dinol and mixtures thereof.

4. The primer mix of claim 3 wherein said initiating explosive is dinol.

5. The primer mix of claim 2 wherein said sensitizer is tetracene.

6. The primer mix of claim 2 wherein said propellant is selected from the group consisting of nitrated esters, dinitrotoluene, picric acid and nitroquanidine and mixtures thereof.

7. The primer mix of claim 6 wherein said propellant is a nitrated ester selected from the group consisting of PETN, nitroglycerin, nitrocellulose and mixtures thereof.

8. The primer mix of claim 7 wherein said propellant is a mixture of small nitroglycerin and nitrocellulose flakes.

9. The primer mix of claim 2 wherein said oxidizer is one or more compounds selected from the group consisting of alkaline and alkaline earth nitrates.

10. The primer mix of claim 9 wherein said oxidizer is potassium nitrate.

11. A primer mix consisting essentially of:

from about 10% to about 50% by weight dinol;

from about 2% to about 10% by weight of tetracene;

from about 3% to about 30% by weight of a propellant;

from about 2% to about 20% by weight calcium silicide;

from about 20% to about 50% by weight of potassium nitrate.

12. The primer mix of claim 11 consisting essentially of from about 20% to about 45% by weight dinol;

from about 3% to about 8% by weight of tetracene;

from about 5% to about 25% by weight of a propellant as a mixture of nitroglycerin and nitrocellulose particles;

from about 5% to about 15% by weight calcium silicide;

from about 25% to about 40% by weight of potassium nitrate.

13. The primer mix of claim 12 being essentially free of lead and lead compounds.

14. A percussion primer, comprising:

a primer holder having a generally cup-shaped configuration with a closed end and an open end;

a metallic anvil extending across said open end, said anvil having a centrally depressed region containing at least one aperture; and a primer mix contained within said primer holder and contacting both said closed end of said primer holder and said centrally depressed region of said anvil, said primer mix consisting essentially of an explosive powder which includes dinol mixed with a pyrotechnic powder, said pyrotechnic powder including calcium silicide and an oxidizer.

15. The percussion primer of claim 14 wherein said primer mix consists essentially of from about 10% to about 50% by weight of an initiating explosive, from about 2% to about 10% by weight of a sensitizer, from about 3% to about 30% by weight of a propellant, from about 2% to about 20% by weight calcium silicide and from 20% to about 50% by weight of an oxidizer.

16. The percussion primer of claim 15 wherein said primer mix consists essentially of from about 10% to about 50% by weight dinol, from about 2% to about 10% by weight of tetracene, from about 3% to about 30% by weight of a propellant, from about 2% to about 20% by weight calcium silicide and from about 20% to about 50% by weight of potassium nitrate.

17. The percussion primer of claim 16 wherein said primer mix is essentially free of lead and lead compounds.

18. A percussion primer, comprising:

a primer holder having a generally cup-shaped configuration with a closed end and an open end; and a primer mix contained within said primer holder and consisting essentially of an explosive powder which includes dinol mixed with a pyrotechnic powder, said pyrotechnic powder including calcium silicide and an oxidizer.

19. The percussion primer of claim 18 wherein said primer mix consists essentially of from about 10% to about 50% by weight of an initiating explosive, from about 2% to about 10% by weight of a sensitizer, from about 3% to about 30% by weight of a propellant, from about 2% to about 20% by weight calcium silicide, and from about 20% to about 50% by weight of an oxidizer.

20. The percussion primer of claim 19 wherein said primer mix consists essentially of from about 10% to about 50% by weight dinol, from about 2% to about 10% by weight of tetracene, from about 3% to about 30% by weight of a propellant, from about 2% to about 20% by weight calcium silicide and from about 20% to about 50% by weight of potassium nitrate.

21. The percussion primer of claim 20 wherein said primer mix is essentially free of lead and lead compounds.

* * * * *